US011454379B2

(12) United States Patent
Verhoeven

(10) Patent No.: US 11,454,379 B2
(45) Date of Patent: Sep. 27, 2022

(54) STAND AND LIGHTING DEVICE

(71) Applicant: SIGNIFY HOLDING B.V., Eindhoven (NL)

(72) Inventor: Mark Johannes Antonius Verhoeven, Deurne (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 17/257,046

(22) PCT Filed: Jun. 27, 2019

(86) PCT No.: PCT/EP2019/067179
§ 371 (c)(1),
(2) Date: Dec. 30, 2020

(87) PCT Pub. No.: WO2020/007708
PCT Pub. Date: Jan. 9, 2020

(65) Prior Publication Data

US 2021/0262642 A1 Aug. 26, 2021

(30) Foreign Application Priority Data

Jul. 2, 2018 (EP) ..... 18181184

(51) Int. Cl.
*F21V 17/10* (2006.01)
*E05C 17/04* (2006.01)
(Continued)

(52) U.S. Cl.
CPC ..... *F21V 17/107* (2013.01); *E05C 17/04* (2013.01); *F21S 8/086* (2013.01); *F21V 15/01* (2013.01);
(Continued)

(58) Field of Classification Search
CPC . F21S 8/085; F21S 8/086; F21S 8/088; E05C 17/04; F21V 17/107; F21V 15/01; F21V 15/012
See application file for complete search history.

(56) References Cited

U.S. PATENT DOCUMENTS

2011/0038153 A1* 2/2011 Hu ..... F21V 29/83 362/249.02
2013/0107427 A1 5/2013 Cheng

FOREIGN PATENT DOCUMENTS

CN 2682284 Y 3/2005
CN 101655224 B 2/2010
(Continued)

*Primary Examiner* — Colin J Cattanach
(74) *Attorney, Agent, or Firm* — Daniel J. Piotrowski

(57) ABSTRACT

A stand for a lidded box such as a luminaire and a lighting device comprising said stand. Said stand comprising a rotatable resilient stay and comprising a bridge portion connecting two transversal portions. Each transversal portion having a respective axial portion extending over a rotation axis. Said stand further comprising two facing supports comprising a seat. The seat being elongated in a length direction transverse to the rotation axis, said length direction and rotation axis extend in a plane P. Each axial portion being accommodated in a respective axially extending hole, provided in a respective support, the respective holes and seat being positioned aligned on the rotation axis. The transversal portions having a connect portion connecting the transversal portion with its axial portion, whereby in a seated position of the stay the connect portion extends through the seat in plane P and at an angle α with the length direction, with α in a range of 25° to 75°.

15 Claims, 6 Drawing Sheets

(51) Int. Cl.

| | |
|---|---|
| ***F21V 15/01*** | (2006.01) |
| ***F21V 21/06*** | (2006.01) |
| ***F21S 8/08*** | (2006.01) |
| ***F21W 131/103*** | (2006.01) |

(52) U.S. Cl.
CPC ..... *F21V 21/06* (2013.01); *F21S 8/085* (2013.01); *F21S 8/088* (2013.01); *F21V 15/012* (2013.01); *F21W 2131/103* (2013.01)

(56) References Cited

FOREIGN PATENT DOCUMENTS

| | | | | | |
|---|---|---|---|---|---|
| CN | 201803328 | U | | 4/2011 | |
| CN | 202469762 | U | | 10/2012 | |
| CN | 103032754 | A | | 4/2013 | |
| CN | 203686788 | U | | 7/2014 | |
| CN | 104406073 | A | | 3/2015 | |
| CN | 204922841 | U | | 12/2015 | |
| CN | 107975734 | A | * | 5/2018 | |
| CN | 109084236 | A | * | 12/2018 | ..... F21S 8/086 |
| JP | 2004342469 | A | | 12/2004 | |
| KR | 20050004346 | A | | 1/2005 | |
| KR | 20110006730 | U | | 7/2011 | |
| WO | 2015063805 | A1 | | 5/2015 | |

* cited by examiner

STAND AND LIGHTING DEVICE

CROSS-REFERENCE TO PRIOR APPLICATIONS

This application is the U.S. National Phase application under 35 U.S.C. § 371 of International Application No. PCT/EP2019/067179, filed on Jun. 27, 2019, which claims the benefit of European Patent Application No. 18181184.5, filed on Jul. 2, 2018. These applications are hereby incorporated by reference herein.

FIELD OF THE INVENTION

The invention relates to a stand and to a lighting device comprising said stand.

BACKGROUND OF THE INVENTION

In order that maintenance work on lighting equipment such as replacement and cleaning of street lamps, tunnels luminaires, luminaires installed in places subject to high altitude or traffic volume, can be done easily and quickly, the lighting equipment usually is provided with a latch or stand. A luminaire comprising a latch is, for example, disclosed in CN104406073A. The known luminaire comprises upper cover hingingly connected via a rotation body to a luminaire body. The rotation body comprises a rotatable stay wherein one end is fixed at the rotation body and wherein the other end of the rotatable stay is pressed by the weight of the cover against a stopper provided on the cover itself to enable the cover to stay in an open position during servicing of the luminaire. The known stand has as disadvantages that it is relatively difficult and expensive to manufacture and that it is relatively unreliable in keeping the cover in open position.

SUMMARY OF THE INVENTION

It is an object of the invention to provide a stand in which at least one of the disadvantages of the known stand are counteracted. Thereto the invention provides a stand comprising:

a resilient stay rotatable about a rotation axis and comprising a bridge portion connecting two transversal portions at a respective first end thereof, each transversal portion at a second end thereof having a respective axial portion extending over the rotation axis, two facing supports, at least one support comprising a seat, the seat being elongated in a length direction transverse to the rotation axis, said length direction and rotation axis define a plane P, each axial portion being at least partly accommodated in a respective axially extending hole, provided in a respective support, the respective holes and seat being positioned aligned on the rotation axis, at least one transversal portion having a connect portion connecting the transversal portion at the second end with its axial portion, whereby in a seated position of the stay the connect portion extends through the seat in plane P and at an angle $\alpha$ with the length direction, with $\alpha$ in a range of 25° to 75°, preferably 30° to 60°, the stay being configured to enable disengagement of the at least one connect portion from the seat through resilient deformation of the stay for enabling rotation of the stay about the rotation axis. If the angle $\alpha$ is less than 25°, the functioning of fixation of the stay in the support does not work properly enough, while when the angle $\alpha$ is more than 75°, the required volume for accommodating the stand is too large.

The last paragraph of the claim could be phrased in other words, for example that in a seated position of the stay the connect portion is at least partly accommodated in the seat of the support, with respect to a plane Q normal to the rotation axis the connect portion extends at an angle $\alpha$ from the axial portion, with $\alpha$ in a range of 25° to 75°. The seat can be embodied as a slot, a groove, and/or a depression between two protrusions. The hole can be an aperture, a slot or a depression or recess. Due to the fact that in seated positions the connect portion accommodates in the seat at an angle in between 25-75° with respect to the elongated direction of the seat, the stay is blocked against rotation and hence cannot rotate about the rotation axis but is kept fixed in its actual orientation. The stay is rotatable between positions upon resilient deformation of the stay, essentially said resilient deformation is in the axial direction. In particular the two transversal portions are being forced towards each other in axial direction by a clamping force, for example by pinching it by two fingers. By said clamping force the two transversal portions are forced to move towards each other and the at least one connect portion is disengaged from (moved out of) its seat and the axial portion is brought into the seat thus enabling the rotation of the stay. By reduction of the clamping force below the spring force of the stay, the transversal portions move away from each other, and if in the right orientation of the stay with respect to the support and seats, the connect portion is brought (back) into a seat for keeping the stay in a fixed orientation. In a first position of the stay the connect portion rests in a first orientation in the seat, and in a further position the connect portion rests in the seat in a further orientation, different from the first orientation. Thus the stand according to the invention is relatively simple to be operated/used and yet cheap, simple and save in keeping its orientation. Typically the stay is formed in one piece from rigid metal wire or polymer material and elastically or resiliently deformable by exerting a clamping force on the transversal portions near their respective second ends to (resiliently) move the second ends towards each other.

The stand typically can be applied for a box having a lid, for example a cover and housing of a luminaire or a hood of a motor car vehicle, in which the lid is to be kept safely in an open position with respect to the box, without the risk on unintended/sudden fallen back into closed position involving the risk of injuries on maintenance workers performing servicing operation. For example, if the lidded box is a lighting device, for example a street light luminaire, the stand can conveniently be used in keeping the cover of the street light luminaire safely in open position during servicing operations to be done in the housing of the luminaire.

The stand could have the feature that each support comprises a respective seat. This enables the advantage of a more reliable (temporarily) fixing of the stay in a first or further orientation is obtained and the load on the stay exerted by the weight of the cover is more evenly, i.e. more symmetrically, distributed over the stay. In particular this advantage is obtained if the stand has the feature that each transversal portion has a respective connect portion connecting the respective transversal portion at its respective second end with its respective axial portion, whereby in a seated position of the stay each respective connect portion rests in its respective seat of its respective support.

The stand could have the feature that the connect portions mutually extend in mirrored direction with respect to a plane Q normal to the rotation axis. This enables the possibility to mount the stay in a 180 degrees rotated position in the supports, thus providing more possible orientations of the stay. In particular said 180 degrees rotation is about an axis extending in plane Q, through the bridge and being perpendicular to the rotation axis.

The stand could have the feature that the transversal portions extend substantially in a radial direction away from the rotation axis, and the connect portion extends at an angle β with respect to plane P, with 20°<=β<=160°, or stated otherwise, with respect to the direction of the transversal portions, the connect portions extend in a direction at an angle β, with 20°<=β<=160°, for example 45°<=β<=135° Mostly β will be about 90 degrees and substantially be the same for both connect portions as this involves that the lid of a box, for example a cover of a luminaire housing, will be maintained in an opened position with the cover extending in opened position at 90 degrees from the box. Other angles β will result in the cover extending at other angles from the box. The angle β being different for a respective connect portion will result in more, i.e. three or four, fixed positions/orientations of the stay. The angle by which the cover extends from the box in opened position and/or the degree by which the stay presses against the cover in closed position, for example to avoid rattling of the stay against a hood of a motor vehicle during driving, may be conveniently chosen by choosing the stay having a corresponding angle β. Substantially radial direction in this context means that the mathematical radial direction is approached but is not exactly followed due to the assumed offset position of the transversal portions because of their connection to the axial portions via the connect portions.

The stand could have the feature that the transversal portions are in mutually inclined orientation. This feature provides alternative possibilities to an embodiment in which the two transversal portions extend parallel to each other, in which case the bridge portion extends in axial direction over a length L and the two supports are spaced apart in axial direction by a same distance of practically L. The inclined orientation of the transversal portions means that the bridge portion could have a size different from the spacing between the supports in axial direction and result, for example, in that the two transversal portions extend towards or away from each other in a direction away from the rotation axis. The shape of the stay thus could be optimally adapted to the available space in the envisaged application.

The stand could have the feature that the stay is a shaped rod having a cross diameter Rd and the seat has a width W in a range of 1*Rd<W<=2*Rd, preferably 1.1*Rd<=W<=1.5*Rd. If the width of the seat is equal or less than Rd, portions of the stay cannot be brought into the seat, hence W should be larger than Rd, preferably with a small play to facilitate the introduction of portions of the stay into the seat, therefore preferably W is at least 1.1*Rd. On the other hand, the width W of the seat should not be too large, i.e. W should be equal or less than 2*Rd, as this renders the 'temporarily fixed' orientation of the stay too variable. In practice it appears that a satisfactorily limited variation in said 'fixed' orientation is obtained when W is equal or less than 1.5*Rd. A same reasoning applies mutatis mutandis for a diameter of the hole in the support, in which the axial portions are at least partly accommodated. Alternatively, in most cases it can be stated that a play in a range of 0.2 mm to 0.5 mm between the cross diameter Rd of the stay and the width W of the seat is adequate for obtaining the desired functionality of operation of the stand.

The stand could have the feature that the connect portion rests in the seat while exerting a pressing force against the support. This ensures an even more reliable "temporarily fixation" of the stay in the seat when the stay is in a seated orientation/position. When the transversal portions of the stay are located in between the supports, the pressing force is exerted in an outward direction, i.e. the transversal portions move away from each other if the stay would be removed from the supports.

The stand could have the feature that the supports are arranged as two mutually aligned parts. As an alternative, the stand could have the feature that the supports are mutually slightly tilted over the rotation axis, for example by 2 to 15 degrees. This results in the connect portions to extend in the seats at slightly different angles and counteract small movements in orientation of the stay in the first and/or second orientation/position as by this slight tilt the play of the stay with the connect portions in the seats, i.e. when the stay is in the first or second orientation/position, is essentially compensated. The stand could further have the feature that both supports are integrated parts in one piece. Thus a simplification of assembling the stand is obtained as the number of parts of the stand is reduced as well as that some parts are already mutually pre-positioned.

The stand could have the feature that the supports are die casted. Die casting is a simple, convenient and cheap manufacturing method, rendering the stand even cheaper with respect to the known stand.

In an alternative embodiment the stand could have the feature that the two main surfaces are end faces of a single, solid support body. Also in this case the stand could have the feature that the connect portion rests in the seat while exerting a pressing force against the support. In this case the transversal portions of the stay are located on the outside of the supports, the pressing force then is exerted in an inward direction, i.e. the transversal portions move towards each other if the stay would be removed from the supports. Typically the stand then could have the feature that the bridge portion extends in axial direction over a length L and the two main surfaces are spaced apart in axial direction by a distance <L.

The stand could have the feature that each seat is formed as a slot having an open side and comprising both a respective seat and hole at the open side of the slot, and wherein the open side of the slot is reversibly closeable, for example by a screw, a rotatable lid or a hook as closing means. This enables a simple exchange of different stays (to be) accommodated in the supports, without the risk of permanent deformation of the stand as could more likely be the case when the stay has to be removed from the stand by axially forcing the axial portions out of the holes.

The stand could have the feature that the connect portions extend at mutually different angle β from plane P. When the difference in angle β, i.e. Δβ, between the two connect portions is in the range of 3 to 10 degrees, essentially the same effect is obtained as when the supports are mutually slightly tilted over the rotation axis, for example by said 3 to 10 degrees. This results in the connect portions to extend in the seats at slightly different angles and counteract small movements in orientation of the stay in the first and/or second orientation/position as by this slight tilt the play of the stay with the connect portions in the seats, i.e. when the stay is in the first or second orientation/position, is essentially compensated. Yet, if the difference in angle β between the two connect portions is significantly larger than 10 degrees, for example between 45 and 135 degrees. This has the advantage that a stand is obtained with a stay having three or four positions/orientations in which one connect portion is seated in a seat of the stay, i.e. there are three or four positions in which the stay is blocked against rotation and hence cannot rotate about the rotation axis but is kept fixed in its actual orientation.

The invention further relates to a luminaire/lighting device comprising a stand according to the invention. Lighting device could for example be a cover of a luminaire housing. In particular such a stand finds application in luminaires/lighting devices which need servicing in places subject to high altitude or traffic volume. Said servicing can be done easily and quickly when the person has two hands available and yet is not exposed to a significant risk of the cover falling on his hands when working at the light engine accommodated in the housing of the luminaire.

Luminaire/Lighting device could have the feature that the luminaire comprises a housing typically for accommodating a light engine and a housing part, for example a cover, which, via die casting is integrally formed with the supports. A cheap way to manufacture housing parts or covers for luminaires is via die casting. It is convenient to have the supports integrally casted with said housing part/cover in a single manufacturing step. This saves separate manufacture steps of the supports and saves separate mounting steps of the supports on the housing part/cover during the manufacture of the luminaire. Thixomolding can also be used as a manufacturing method as an alternative for die-casting (and plastic injection molding).

BRIEF DESCRIPTION OF THE DRAWINGS

The invention will now be further elucidated by means of the schematic drawings, which are not intended to limit but rather intended to illustrate the invention, in which.

DETAILED DESCRIPTION OF THE INVENTION

Figure 1:
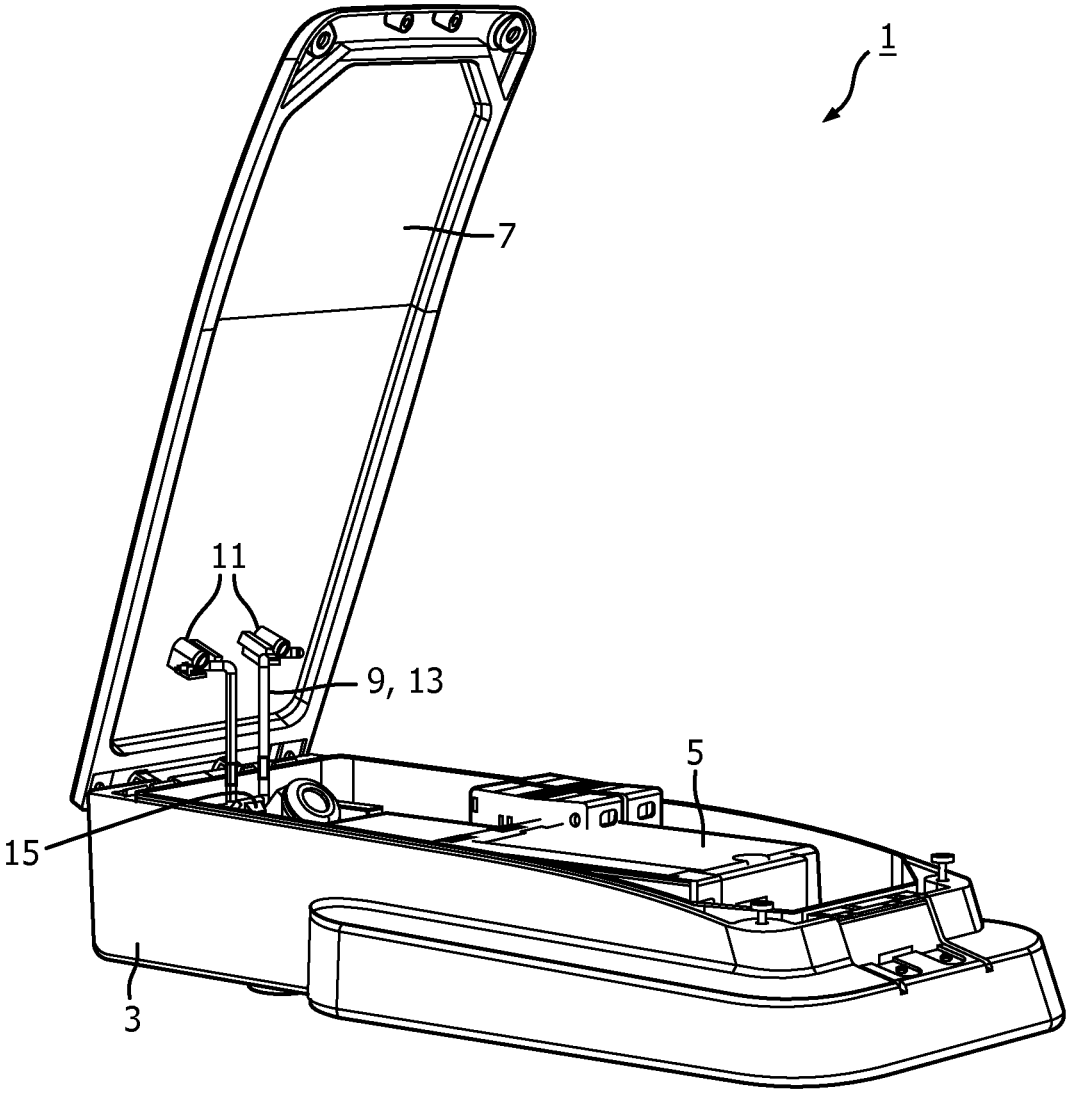
FIG. 1 shows a perspective view of a luminaire according to the invention.
Figure 2:
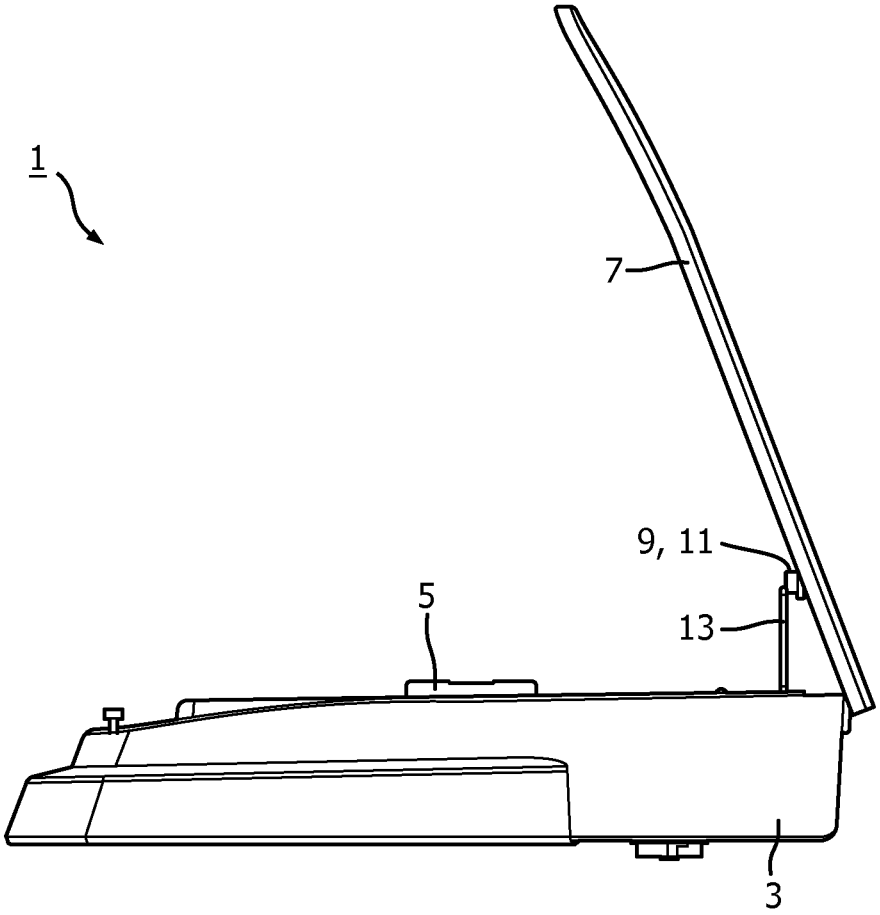
FIG. 2 shows a side view of the luminaire of FIG. 1.

FIG. 1 and FIG. 2 respectively shows a perspective view and a side view of a luminaire 1 according to the invention in an opened position. The luminaire comprises a housing 3 accommodating a light engine 5 and a cover 7 for said housing hingingly connected thereto. The luminaire further comprises a stand 9 by which the cover is kept in an open position with respect to the housing. The stand comprises two supports 11 which are (partly) integrally formed with the cover and in which a stay 13 is partly accommodated. The stay is in a first position/orientation and extends from the supports to a stopper 15 in the housing on which it rests due to the weight of the cover. The stay rests with outwardly directed pressing force, i.e. the transversal portion are urged away from each other, against the supports. Because of the fixed orientation of the stay in the supports, since the stay in its current position in the supports is blocked from rotation, the cover cannot fall down into the closed position thus rendering a safe operation possibility in the housing to people.

Figure 3:
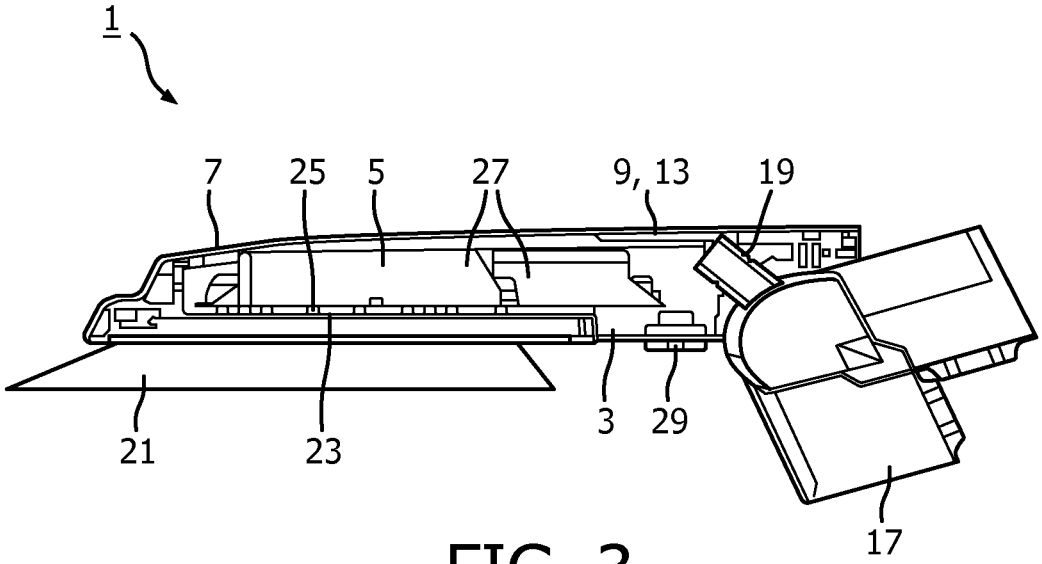
FIG. 3 shows a partly worked open side view of a mounted luminaire in operation.

FIG. 3 shows a partly worked open side view of a closed, street light luminaire 1 in operation, the orientation range with respect to a pole 17 (only partly shown) on which the luminaire is (to be) mounted is also shown. The luminaire has a housing 3 via which the luminaire is mounted onto a pole in a rotatable manner for enabling a correct orientation of the luminaire with respect to the target area to be illuminated, i.e. a street surface. Electric cabling, for providing electric power to the light engine of the luminaire, enters from the inside of the pole into the housing through a cable entry 19. A light engine 5, which issues a light beam 21 through a light exit window 23 of the housing, is accommodated in the housing. The light engine comprises a light source 25, for example a LED, yet in the figure a plurality of LEDs, and driver equipment 27 for driving the light source. The housing of the luminaire is closed with a cover 7 in a sealed manner yet provided with a breather 29 to enable pressure balancing of the inside of the luminaire with the ambient, thus ingress of water and dust is effectively counteracted. A stand 9 is mounted onto the cover and its stay 13 is in its second position/orientation, i.e. the stay rests against the cover, thus the stand requires only very little space in the closed luminaire.

Figure 4A:
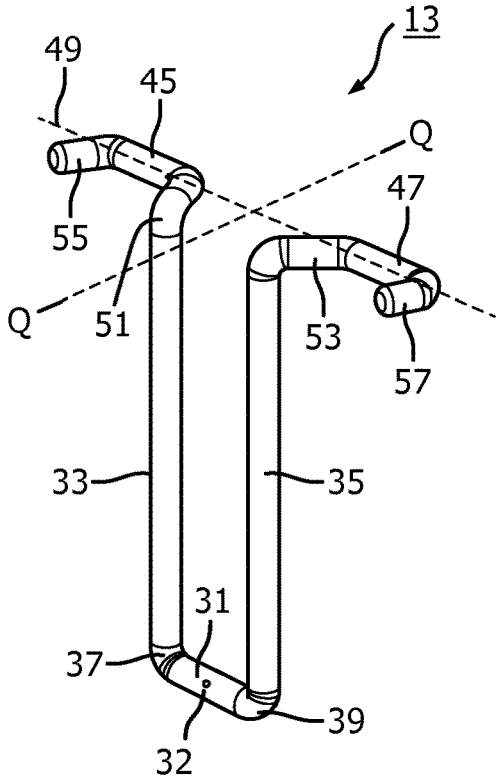
FIG. 4A-F show a various view of a first and of a second example of a stay of a stand according to the invention.

FIG. 4A shows a perspective view of an example of a resilient stay 13 of a stand according to the invention which is mirror symmetrical with respect to a plane Q normal to a rotation axis 49. The stay comprises a bridge portion 31 connecting two parallel, transversal portions 33,35 at a respective first end 37,39 thereof, each transversal portion at a second end 41,43 thereof having a respective axial portion 45,47 extending over the rotation axis 49. Each axial portion being connected to the transversal portions via a respective connect portion 51,53. The axial portions being aligned and positioned on the rotation axis. In the figure the axial portions are each provided with an optional bend end portion 55,57 for blocking the axial portions from unintentional removal from the supports during rotation form a first position/orientation to a second position/orientation of the stay in the supports. The connect portions mutually extend in mirrored direction with respect to a plane Q normal to the rotation axis, said plane Q further extending through a center 32 of the bridge portion 31.

Figure 4B:
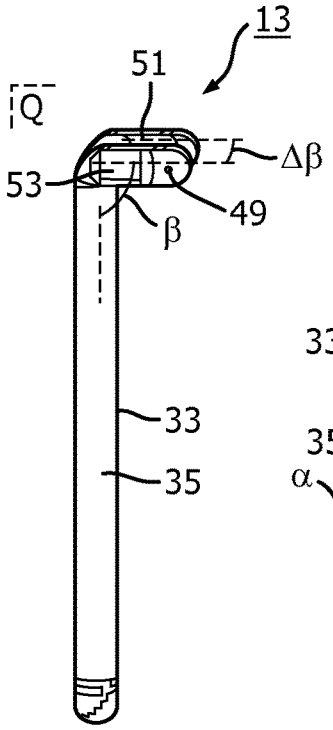

As shown in FIG. 4B, which is a side view of the stay 13 in projection along the rotation axis 49, both connect portions 51,53 extend at the same angle $\beta$ from the transversal portions 33,35, in the figure for both connection portions $\beta$ is 90 degrees, hence the difference in $\beta$ between the two connect portions, i.e. $\Delta\beta$, is 0 degrees.

Figure 4C:
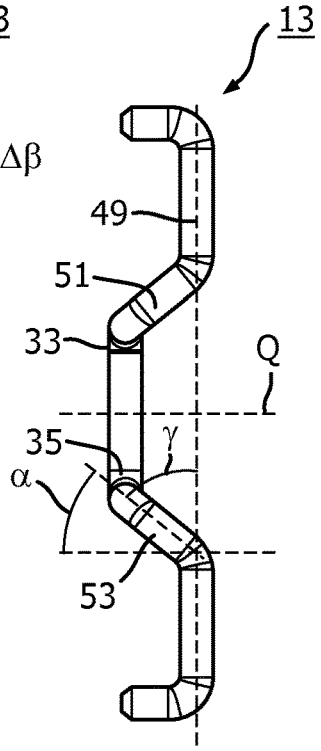

FIG. 4C shows a top view of the stay 13 in a direction along the parallel extending transversal portions 33,35. Here each connect portion 51,53 extends at a same angle $\gamma$ with the axial direction of the rotation axis 49, be it in mirrored orientation, with $\gamma$ in a range of 15° to 65° (which corresponds with angle $90-\alpha$ when the stay is mounted in the supports), in the figure $\gamma$ is 50 degrees.

Figure 4D:
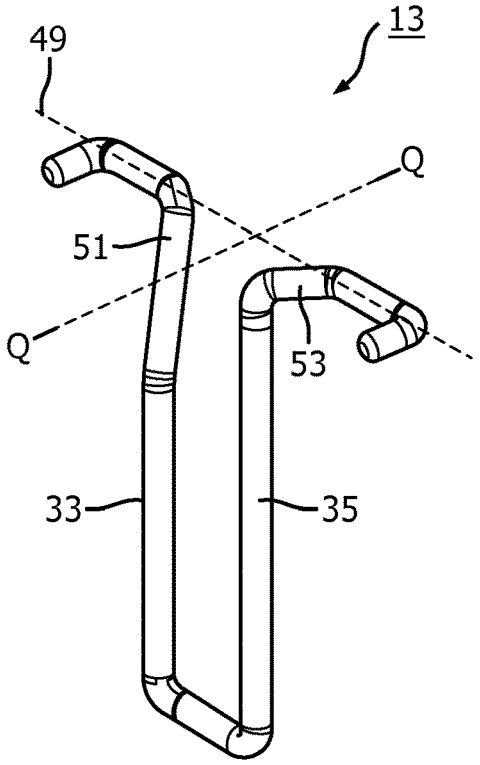
Figure 4E:
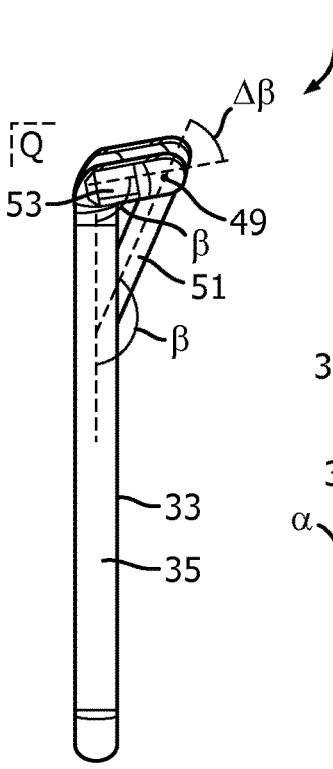
Figure 4F:
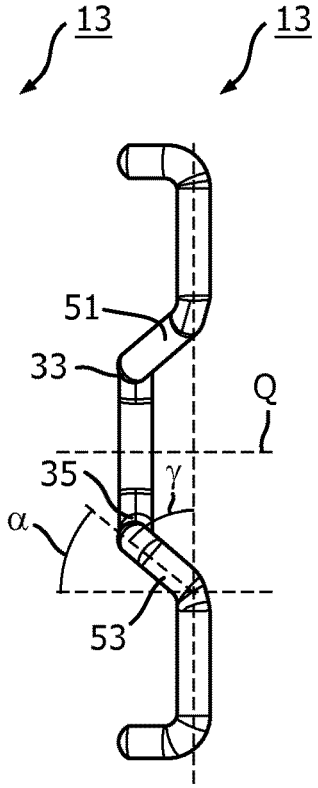

FIG. 4D-F show another example of a stay 13 according to the invention which is asymmetrical with respect to said plane Q in that the connect portions 51,53 extend in different directions from the rotation axis 49, while the transversal portions 33,35 are arranged in a mutually parallel orientation. In particular in this example the angle $\gamma$ (or $90-\alpha$) between the respective connect portion and the rotation axis 49 is the same for both connect portions 51,53, (again in mutual mirrored orientation) while there is a difference $\Delta\beta$ between the respective angle β of each connect portion, β being the angle between the direction of the connect portion and the transversal portions, in the figure for connect portion 51 β is about 165 degrees and for connect portion 53 β is about 100 degrees. Hence, in the figure said difference Δβ is about 65 degrees. When the stay is mounted in the supports, wherein the supports have parallel extending seats, it is thus enabled that the stay can assume four different fixed positions/orientations.

Figure 5A:
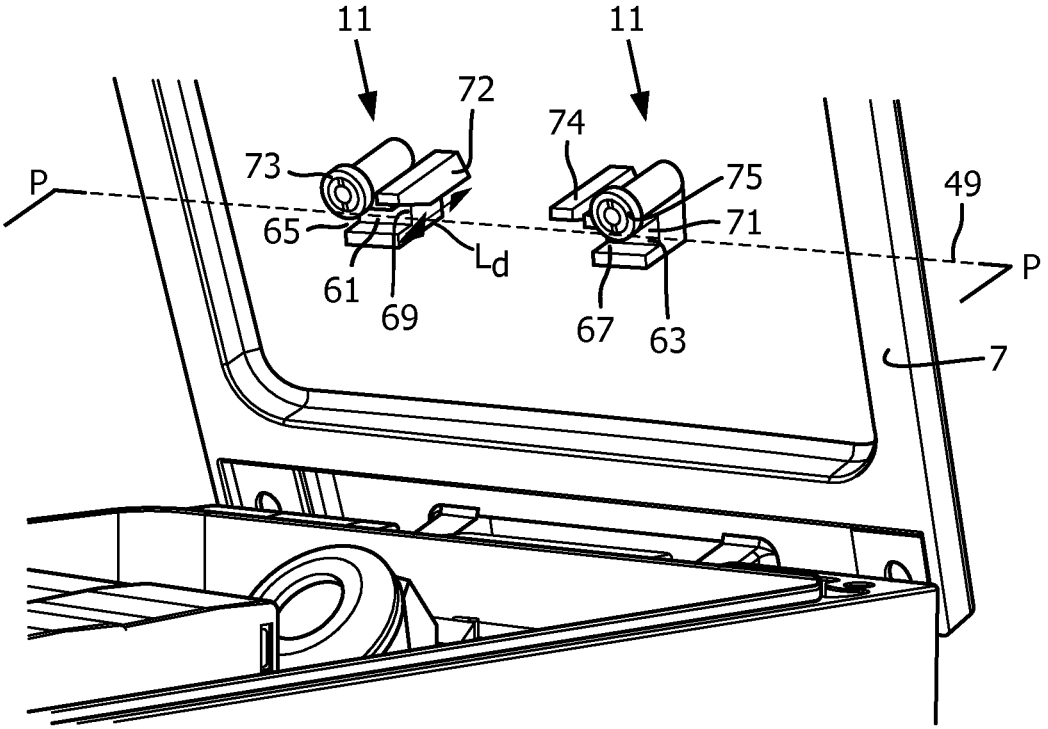
FIG. 5A-B show a perspective view of an example of supports of a stand according to the invention.
Figure 5B:
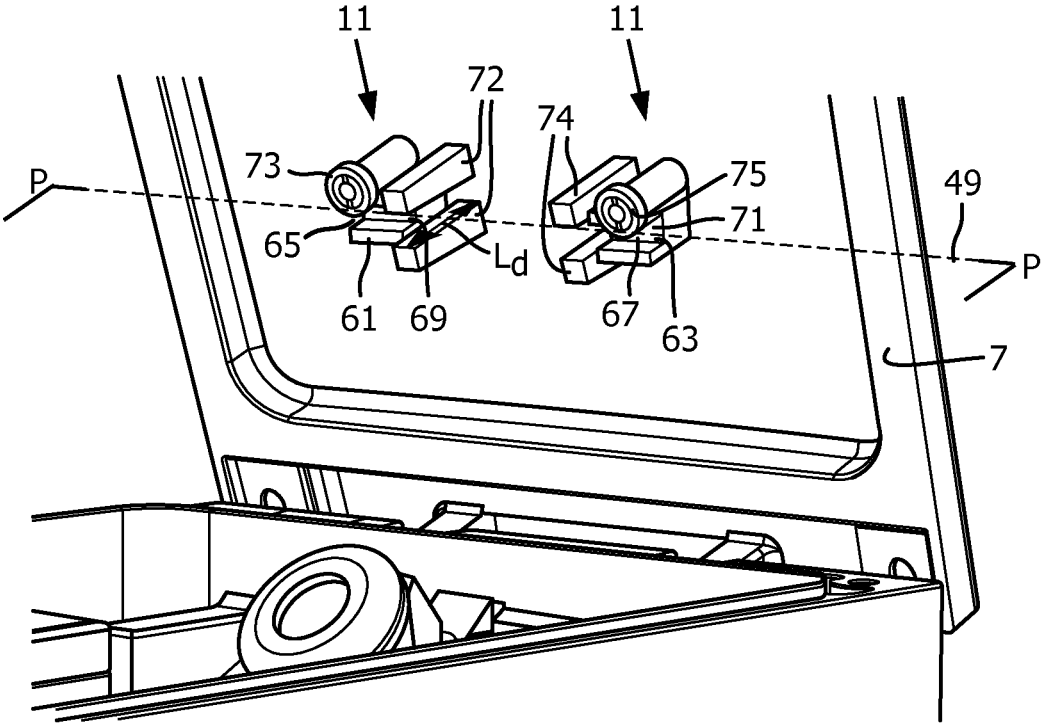

FIG. 5A-B show a perspective view of two examples of two facing supports 11 of a stand according to the invention. Both support comprising a respective seat 61,63, the seat being elongated in a length direction Ld transverse to the rotation axis 49, said length direction and rotation axis extend in a plane P. In FIG. 5A each seat in the length direction Ld has only one respective branch 72,74 extending along plane P, resulting in that the stay is only kept in fixed position/orientation by the seat on one side. In FIG. 5B each seat in the length direction Ld is formed as a slot between two branches 72,74 extending along plane P supporting the stay more stable on both sides in fixed orientation/position. Each of said slots has a respective open side 65,67 and comprises both a respective seat and hole 69,71 at the open side of the slot, and wherein the open side of the slot is reversibly closed by respective screw 73,75 which enables opening and closing of the seat. The two supports are integrated parts in one piece with the cover 7 and are die casted.

Figure 6A:
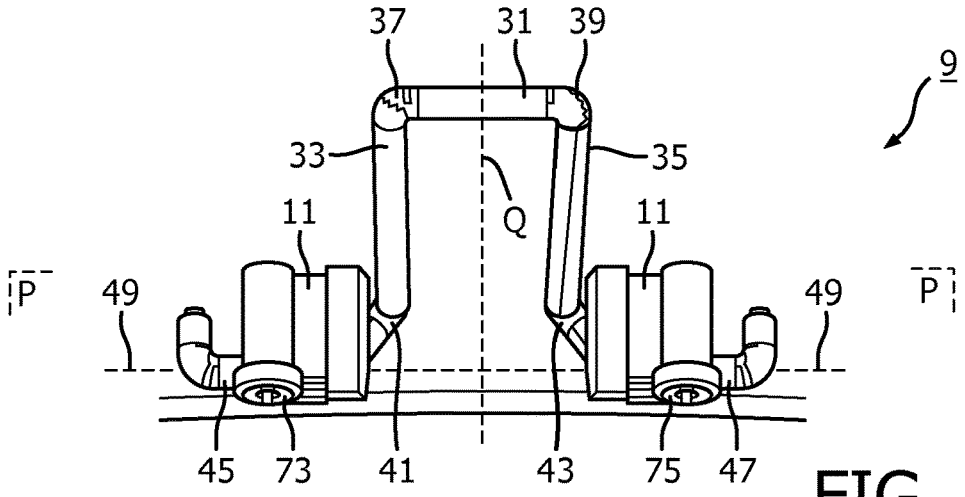
FIG. 6A-C show various views of a stand according to the invention.
Figure 6B:
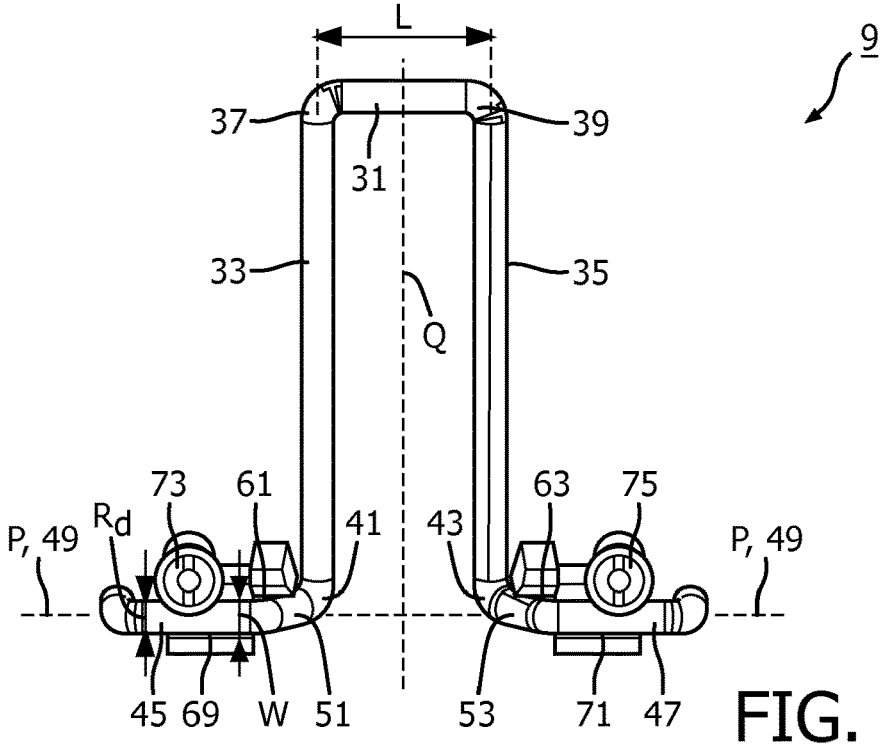
Figure 6C:
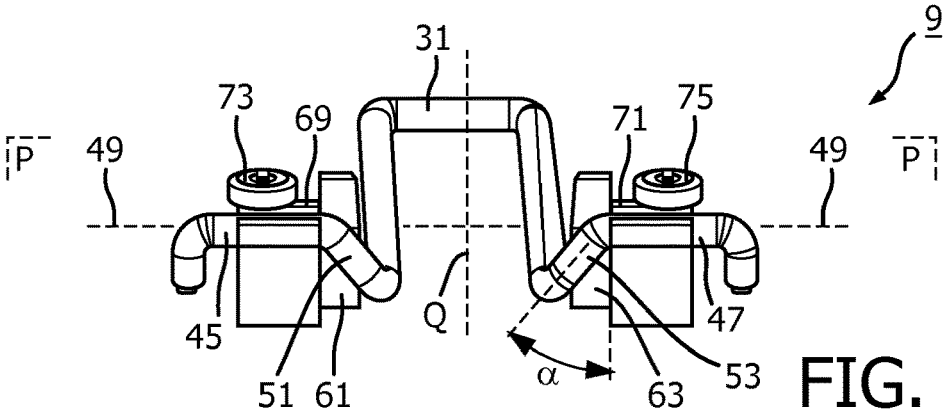

FIG. 6A-C show a stand 9 according to the invention in an assembled configuration in different views to show the various aspects of the stand according to the invention. The stand comprises a resilient stay 13 rotatable about a rotation axis 49. The resilient stay comprises a bridge portion 31 connecting two transversal portions 33,35 at a respective first end 37,39 thereof. Each transversal portion at a second end 41,43 thereof having a respective axial portion 45,47 extending over the rotation axis. Two facing supports 11, both comprising a respective seat 61,63 wherein the seats are elongated in a length direction Ld transverse to the rotation axis, said length direction and rotation axis extend in a plane P. Each axial portion being at least partly accommodated in a respective axially extending hole 69,71, provided in a respective support and closed by a respective screw 73,75. The respective holes and seat are in an aligned position on the rotation axis. Both transversal portions having a respective connect portion 51,53 connecting the transversal portion at the respective second end with its respective axial portion. In a seated position of the stay the respective connect portions extend through the respective seat in plane P and at an angle α with the length direction, with α in a range of 30° to 60°. The connect portions mutually extend in mirrored direction with respect to a plane Q normal to the rotation axis. The transversal portions extend substantially in a radial direction away from the rotation axis, with the rotation axis extending along or in plane P, and the connect portion extends at an angle β with respect to plane P, with 45°<=β<=135°. The stay is a shaped rod having a cross diameter Rd and the seat has a width W in a range of 1*Rd<W<=2*Rd, preferably 1.1*Rd<=W<=1.5*Rd, in the figure W=1.2*Rd. The bridge portion extends in axial direction over a length L and the two supports are spaced apart in axial direction by a distance >L.

Figure 7A:
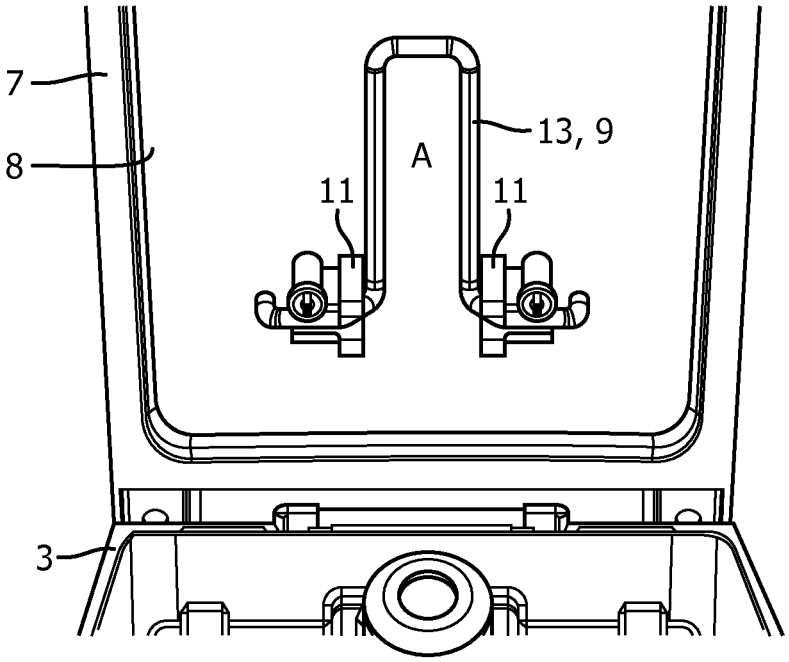
FIG. 7A-B show a luminaire according to the invention with a stand in a first respectively in a second position.
Figure 7B:
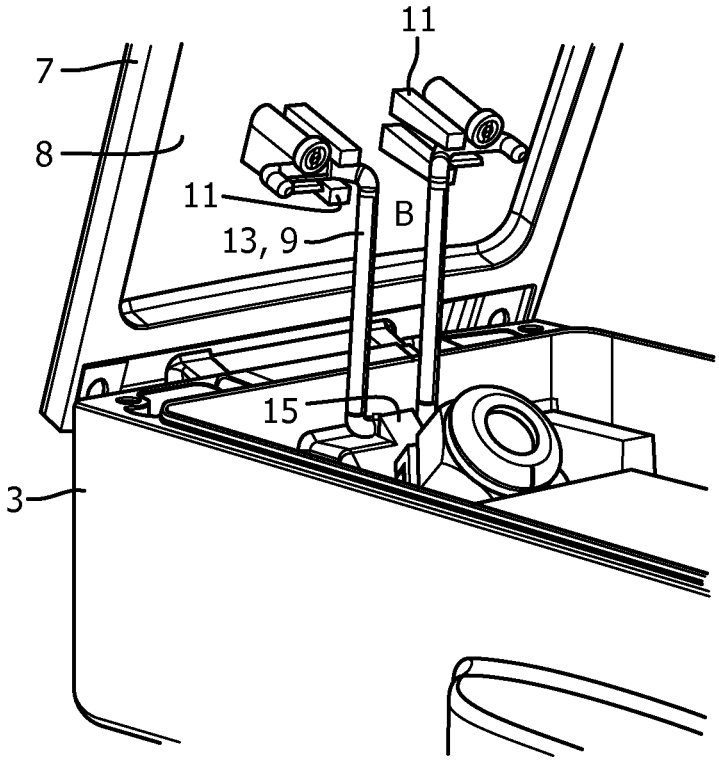

FIG. 7A-B show a luminaire 1 according to the invention with a stand 9 having a stay 13 in a first A respectively in a second position/orientation B. In FIG. 7A the stay is in the first position/orientation A and rests with pressing force against the support 11 and with pressing force against an inner cover main surface 8 of the cover 7, for example caused by a small misalignment of the connection parts, i.e. one connection part is in a slightly rotated position over the rotation axis with respect to the other connection part, for example rotated over an angle δ, with δ in a range of 3 to 10 degrees, in the figure 5 degrees (not shown). Generally the stay is in this first position/orientation when the luminaire housing 3 is closed by the cover. The pressing force exerted by the stay on the supports and inner cover main surface has the positive effect that when the housing moves or vibrates, for example because of being exposed to the wind, the stay is firmly kept in position and rattle will not occur. In FIG. 7B the stay 13 is in the second position/orientation B and rests with pressing force against a stopper 15 provided in the housing, resulting in an essentially non-movable fixation of the stay in second the position/orientation, in particular when the stopper has a slight overhang, the stay can be urged with pressing force under the overhang.

The invention claimed is:

1. Stand for a lighting device comprising:

a resilient stay rotatable about a rotation axis and comprising a bridge portion connecting two transversal portions at a respective first end thereof, each transversal portion at a second end thereof having a respective axial portion extending over the rotation axis, two supports, at least one support comprising a seat, the seat being elongated in a length direction transverse to the rotation axis, said length direction and rotation axis are defined in a plane P, each axial portion being at least partly accommodated in a respective axially extending hole, provided in a respective support, the respective holes and seat being positioned on and aligned with the rotation axis, at least one transversal portion having a connect portion connecting the transversal portion at the second end with its axial portion, whereby in a seated position of the stay, the connect portion extends through the seat in plane P and at an angle α with the length direction, with α in a range of 25° to 75°, the stay being configured to enable disengagement of the at least one connect portion from the seat through resilient deformation of the stay for enabling rotation of the stay about the rotation axis.

2. The stand as claimed in claim 1, wherein each support comprises a respective seat.

3. The stand as claimed in claim 1, wherein each transversal portion has a respective connect portion connecting the respective transversal portion at its respective second end with its respective axial portion, whereby in a seated position of the stay, each respective connect portion rests in its respective seat of its respective support.

4. The stand as claimed in claim 3, wherein the connect portions mutually extend in mirrored direction with respect to a plane Q normal to the rotation axis.

5. The stand as claimed in claim 1, wherein the transversal portions extend substantially in a radial direction away from the rotation axis, and the connect portion extends at an angle β with respect to plane P, with 20°<=β<=160°.

6. The stand as claimed in claim 1, wherein the transversal portions are in mutually inclined orientation.

7. The stand as claimed in claim 1, wherein the stay is a shaped rod having a cross diameter Rd and the seat has a width W in a range of 1*Rd<W<=2*Rd.

8. The stand as claimed in claim 1, wherein the connect portion is positioned in the seat and the stay rests with pressing force against the support.

9. The stand as claimed in claim 1, wherein the bridge portion extends in an axial direction over a length L and the two supports are spaced apart in the axial direction by a distance >L.

10. The stand as claimed in claim 1, wherein the two supports are integrated parts in one piece.

11. The stand as claimed in claim 10, wherein the supports are die casted.

12. The stand as claimed in claim 1, wherein each seat is formed as a slot having an open side and comprising both a respective seat and hole at the open side of the slot, and wherein the open side of the slot is reversibly closeable.

13. The stand as claimed in claim 1, wherein the connect portions extend at mutually different angle β from plane P.

14. A Luminaire or Lighting device, comprising: a stand as claimed in claim 1.

15. The Luminaire or Lighting device as claimed in claim 14, wherein the luminaire comprises a housing portion which is integrally formed with the supports via die casting.

* * * * *